United States Patent [19]

Richard

[11] Patent Number: 4,736,531

[45] Date of Patent: Apr. 12, 1988

[54] ATHLETIC SHOE FOR AEROBIC EXERCISE AND THE LIKE

[75] Inventor: Daniel J. Richard, Grand Rapids, Mich.

[73] Assignee: Wolverine World Wide, Inc., Rockford, Mich.

[21] Appl. No.: 37,415

[22] Filed: Apr. 13, 1987

[51] Int. Cl.[4] ..... A43B 5/00; A43B 13/14; A43B 17/18; A43B 23/07

[52] U.S. Cl. ..... 36/114; 36/10; 36/31; 36/45; 36/55

[58] Field of Search ..... 36/10, 96, 55, 45, 30 R, 36/28, 31, 32 R, 3 A, 59 A, 59 R

[56] References Cited

U.S. PATENT DOCUMENTS

| | | | |
|---|---|---|---|
| 1,664,728 | 4/1928 | Behr | 36/114 |
| 1,803,554 | 5/1931 | Knilans | 36/114 |
| 2,109,884 | 3/1938 | Hill | 36/45 |
| 2,147,197 | 2/1939 | Glidden | 36/45 X |
| 2,205,577 | 6/1940 | Roberts | 36/45 |
| 3,363,342 | 1/1968 | Stohr | 36/28 X |
| 3,555,706 | 1/1971 | Edmonds | 36/114 |
| 4,364,188 | 12/1982 | Tuner et al. | 36/31 |
| 4,402,146 | 9/1983 | Parracho et al. | 36/32 R X |
| 4,541,186 | 9/1985 | Mulvihill | 36/114 |
| 4,559,722 | 12/1985 | Norton | 36/89 |

FOREIGN PATENT DOCUMENTS

| | | | |
|---|---|---|---|
| 540572 | 10/1941 | United Kingdom | 36/55 |

*Primary Examiner*—Stuart S. Levy
*Assistant Examiner*—Thomas R. Hannon
*Attorney, Agent, or Firm*—Price, Heneveld, Cooper, DeWitt & Litton

[57] ABSTRACT

An athletic shoe having an inner, forefoot-enveloping and gripping, elastic slipper sock for encompassing the forepart of the foot, the bottom of the elastic slipper sock being anchored to the sole assembly and being independent of the shoe upper, to move simultaneously with the foot and keep the shoe in tune with the foot. An extended toe bumper has medial and lateral cutouts astraddle the metatarsalphalangeal joint line to form vertically narrower portions. These cooperate with flexible mesh interconnecting portions of a bifurcated vamp in the upper, to effect controlled forefoot independence.

22 Claims, 2 Drawing Sheets

ATHLETIC SHOE FOR AEROBIC EXERCISE AND THE LIKE

BACKGROUND OF THE INVENTION

This invention relates to athletic footwear for aerobics.

Within the last decade, tremendous developments have been made in the construction of athletic footwear. In the early stages of these recent developments, much emphasis was placed on improvements for running and jogging activities. These running shoes have been adopted by the public for many other athletic activities. Although running footwear does often provide certain benefits for other activities, many of these different activities in fact require different characteristics from the footwear.

In aerobic exercise there are many movements not encountered during running and jogging events, and movements that are accentuated in extent and/or rapidity and/or frequency, as contrasted to other athletic activities. Examples of these are repeated, rapid lateral thrust movements and frequent substantial vertical flexing of the foot. Aerobic exercisers spend considerable time on the forefoot. Consequently, a study of footwear and foot movements during aerobic activities has demonstrated the undesirable tendency of the foot to move independently of the shoe far too often, many times even moving partially or totally off of the shoe support. The foot also tends to shift about laterally within the shoe, and in general to move before the shoe moves in response, after which the shoe moves in the direction of the foot in a delayed action, without always terminating in conformity with the foot. In short, the shoe does not stay "in tune" with the foot. Some potential results are general lack of comfort, lack of security and confidence during the exercise, blisters, pain and possible injury. Increasing popularity of aerobic style exercise increases the odds of difficulty.

There have been some prior efforts to incorporate features for keeping athletic shoes on the feet during vigorous activities. These have been in specialty athletic shoes for sports such as basketball and gymnastics, basically to bind the shoe more securely to the foot. These include the use of wraparound gore straps emanating from the heel region of the shoe to fasten tightly at the tongue, to tightly bind the shoe onto the foot, and straps that encircle and bind the midfoot and connect by Velcro(R) fasteners at the instep region. There has also been a totally elastic racing shoe for running races.

SUMMARY OF THE INVENTION

The object of this invention is to provide an athletic shoe especially suited for aerobic exercising, specially constructed to keep the shoe "in time" with the foot. The shoe effects comfortable containment of the foot even during the abrupt lateral thrusts and extended vertical flexes experienced in this vigorous activity.

The athletic shoe of this invention comprises a specially formed combination of elastic forefoot slipper sock within a footwear shell, the elastic slipper sock being integrally anchored within the sole assembly but basically unattached to the shoe upper. It extends beneath the inner sole, being bonded to the sole assembly beneath the inner sole. The forefoot elastic slipper sock extends throughout the forepart of the shoe to totally encompass the forepart of the foot. The slipper sock has a rearwardly-upwardly oriented, foot-receiving opening defined by a forwardly-upwardly extending peripheral edge extending up from the heel region of the sole to the instep region at the tongue area. The portion of the slipper sock over the instep region of the foot includes a foam cushion layer serving also as the shoe tongue.

The shoe has an extended polymeric toe bumper which not only extends around the toe of the shoe but also extends back on the medial and lateral sides beyond the widest part of the shoe to the narrower instep region. This stability-adding toe bumper has medial and lateral cutouts producing vertically narrower and flexible connector portions adjacent and astraddle the ball region of the foot. These provide forefoot shoe flexibility relative to the rest of the shoe, giving controlled independence to the forefoot sole. The extended toe bumper also inhibits toe delamination. This toe bumper cooperates with a U-shaped flex gap extending forwardly along both sides of the shoe and across the top, and containing mesh fabric to connect the adjacent two portions of the vamp. These features facilitate shoe flex in direct response to movement of the elastic slipper sock with the foot.

DESCRIPTION OF THE PREFERRED EMBODIMENT

Figure 1:
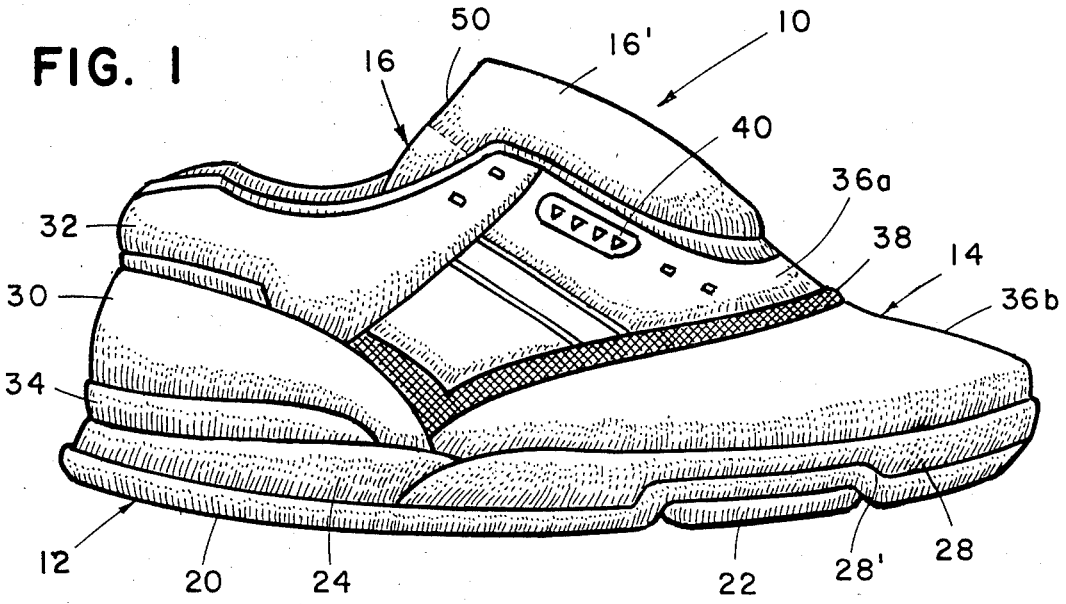
FIG. 1 is a side elevational view of a shoe made in accordance with this invention.
Figure 2:
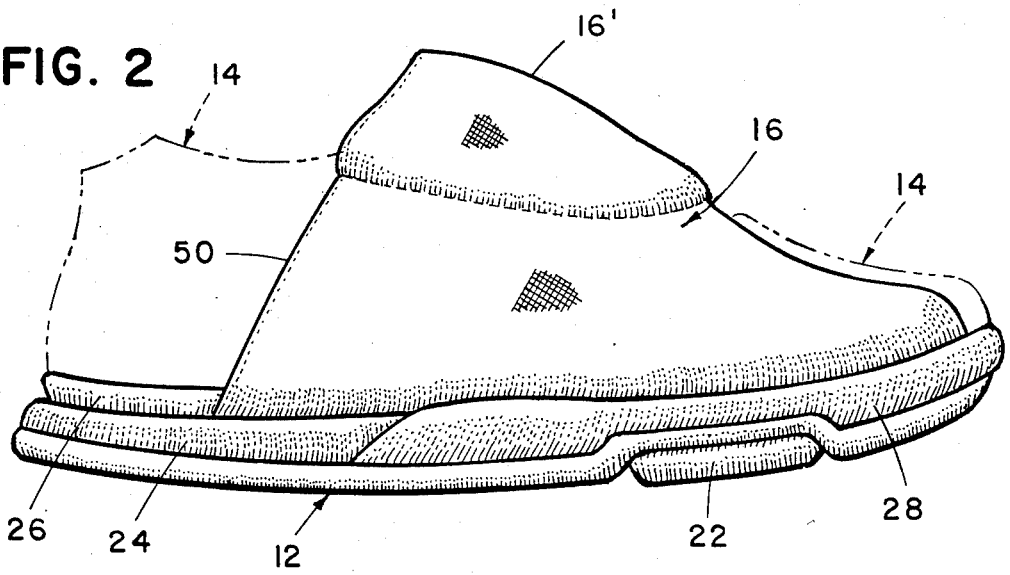
FIG. 2 is a side elevational view of the shoe sole assembly and integrally bonded elastic slipper sock, with portions of the shoe upper shell shown in phantom.

Referring now specifically to the drawings, the novel aerobic exercising shoe 10 includes a sole assembly 12 and an upper assembly 14 defining a foot receiving cavity and including an outer shell and an elastic forefoot slipper sock 16 for enveloping and gripping the forepart of the foot.

Sole assembly 12 includes an outer polymeric sole 20 which incorporates an integrally molded transverse polymeric section 22 underlying the widest part of the shoe beneath the metatarsal-phalangeal joint line, to be beneath what is commonly called the ball of the foot, extending from the lateral side to the medial side of the shoe. This section 22 has a durometer significantly less than the remaining portions of outer sole 20, for cushion resilience and flexibility. Specifically, section 22 is of a soft gum rubber or natural rubber with a durometer of about 50–55 Shore A scale, whereas outsole 20 is a hard rubber with a durometer of about 70 Shore A scale. The bottom of section 22 is substantially at the same level as the bottom of the outer sole, generally. The sole assembly also includes a polymeric midsole 24 which extends the full length of the sole assembly. In typical fashion, midsole 24 has a lower durometer and greater compressibility than outer sole 20, being an EVA polymer with a durometer of about 55 Shore C scale. An inner sole 26 is installed in a manner to be described in more detail hereinafter.

Figure 3:
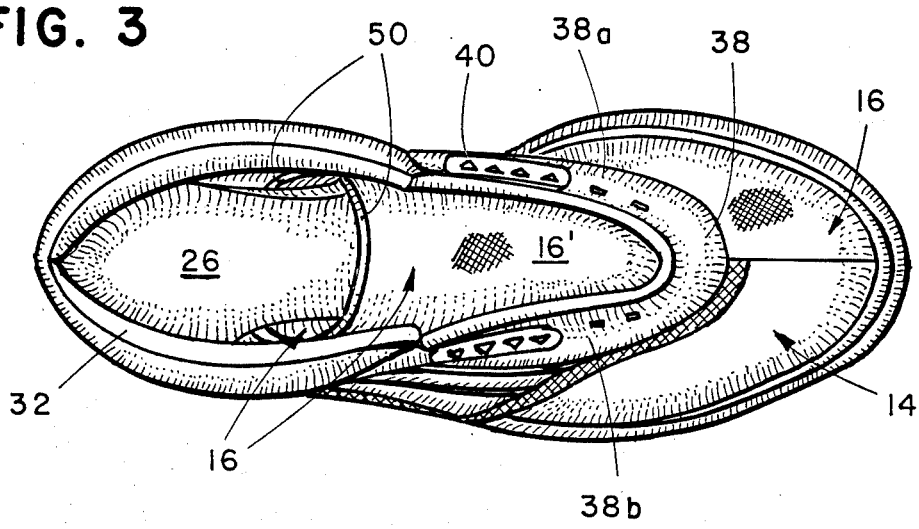
FIG. 3 is a top plan view of the shoe, with the left front quarter portion of the vamp being cut away to depict the underlying forefoot slipper sock for illustrative purposes.
Figure 4:
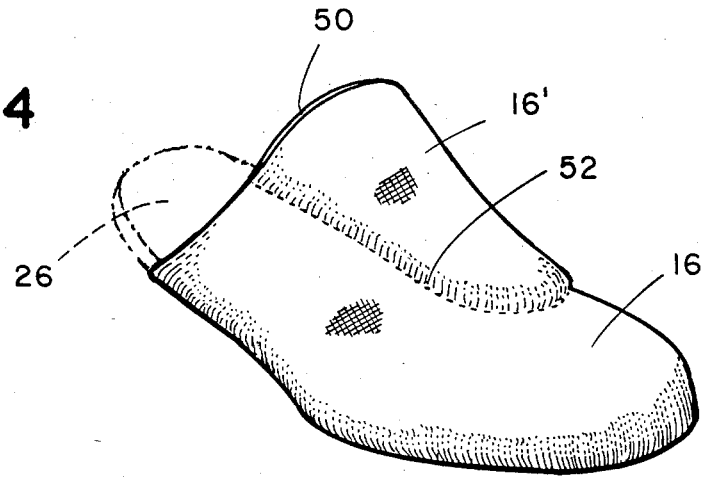
FIG. 4 is a perspective view of the elastic forefoot slipper sock, with the rear portion of the inner sole shown in phantom.

Shoe upper 14 is an outer shell, preferably of leather, which includes a lower heel portion 30 and an upper heel portion 32, the forward end of the latter terminating at the lacing strips and also defining an upper foot-receiving opening. Extending around lower heel portion 30 is a rigid heel cup 34 for reinforcement and stability. This heel cup is typically of a stiff polymer bonded to midsole 24 around the periphery of the heel cup. The forward portion of shoe upper 14 is a vamp which is bifurcated into upper vamp portion 36*a* and toe vamp portion 36*b*, these being separated from each other by a U-shaped gap which extends along both sides of the shell and across the top, forwardly of the lacing strips. Extending across this gap is a narrow band of porous mesh fabric 38, as of nylon or the equivalent. This band thus extends around in front of the U-shaped lacing strip 38 which has two lacing strip portions 38*a* and 38*b* (FIG. 3). Laces (not shown) extend across the lacing opening to form closure means in conventional fashion. The lacing strip has opposite lacing orifices 40 such as the speed lacing orifices depicted in FIGS. 1 and 3. Mesh 38 extends, therefore, around both the medial and axial sides of the shoe upper, in a downwardly-rearwardly direction adjacent the instep portion of the foot, and then upwardly rearwardly to abut heel portion 32 (FIG. 1).

A semi-rigid toe bumper 28 vertically overlaps the midsole and a small bottom portion of the toe, as well as the juncture between the midsole and toe. This toe bumper extends rearwardly past the widest portion of the shoe which is at the metatarsal-phalangeal joint line, and back to the instep portion as depicted. Adjacent the opposite edges of flex member 22, there are vertical cutouts 28' in the lower portion of the toe bumper forming vertically narrower connections at those locations, so that the vertical dimension of this toe bumper is considerably less. These effect vertical flexibility to the shoe and, especially when combined with the flexibility offered by the gap and mesh band 38 in the shell upper, enable the forefoot portion of the shoe to have controlled independence with optimum flexibility.

Located within the shell of the shoe upper is the special elastic forefoot slipper sock 16. This slipper sock is made of a four way stretch material such as Spandex(TM) or equivalent materials on the market. This elastic member extends throughout the entire forepart of the shoe, having an upwardly-rearwardly oriented foot-receiving opening defined by a peripheral edge 50 which tapers upwardly-forwardly from the heel region at the bottom, i.e., at the sole, to the instep region at the top, i.e., at the tongue area. This instep, tongue region includes a thin layer of foam material at 16', retained in position within a dual layer of the stretch material as by a series of surrounding stitches 52. This effects cushioning and serves as a shoe tongue.

This elastic slipper sock, which is preferably seamless, includes a bottom which is anchored within the sole assembly, preferably by adhesive bonding. It extends beneath the inner sole to be between the inner sole and the midsole. The bottom of member 16 is bonded to the underlying midsole 24 and also to the overlying inner sole 26. The extension of this bottom part beneath the front part of the heel combined with the top part extending over the instep at the tongue causes the rising rear part of the foot to elastically torque the rear of the shoe upper shell into a following movement. The remaining portion of the elastic slipper sock, however, is basically, and preferably totally, unconnected to the shoe upper so as to be free to move simultaneously with the foot by stretching. In an experimental model, a tacking stitch was placed between the shoe upper and member 16 at one location. Although this construction was advantageous compared to the prior art, the totally unconnected arrangement is functionally notably better and preferable.

The insole can be a single member or two members. If it is composed of two members, the bottom member is bonded to the underlying slipper sock while the top member is normally simply positioned on top of the bottom member and left unadhered.

Conceivably the elastic member could be extended to encompass the entire heel region of the foot, as well as the forepart of the foot. However, it has been determined that this does not add to the benefits and complicates putting the shoes on one's feet.

The novel shoe assembly has demonstrated remarkable capacity to keep "in tune" with the foot during vigorous aerobic exercises. The elastic slipper sock tightly envelops the forepart of the foot, lending comfort and security while containing the foot, i.e., supplying comfort containment. The slipper sock moves totally simultaneously with the foot, stretching momentarily away from the shoe as necessary, but almost immediately bringing the shoe into total conformity with the foot. This rapid reaction of the shoe to the slipper sock and foot combination is further aided by the narrower regions at the cutouts in the toe bumper and the flex gap and connecting band between the two portions of the vamp. This porous flex band also aids in breathing of the shoe.

Certain additional advantages and features may be apparent to those in the art upon studying this disclosure, or may be experienced by persons employing the novel shoe structure. Furthermore, certain minor variations could conceivably be made in the construction without departing from the concept presented. Therefore, the invention is intended to be limited not by the specific details of the preferred illustrative embodiment set forth, but only by the scope of the appended claims and the reasonably equivalent structures thereto.

The embodiments of the invention in which an exclusive property or privilege is claimed are defined as follows:

1. An athletic shoe for aerobic exercising and the like comprising:

a sole assembly;

an upper secured to said sole assembly, defining a foot-receiving cavity and having closure means for retention of the shoe on a foot;

a forefoot-enveloping and gripping, elastic slipper sock in said cavity encompassing the forepart of said cavity, said elastic slipper sock having a bottom anchored to said sole assembly and free to grip onto a foot in said cavity independent of said upper; and an insole having a forward portion in said slipper sock on the inner upper surface of said slipper sock bottom.

2. The shoe in claim 1 wherein said elastic slipper sock is substantially unattached to said shoe upper to be generally free to stretch and move relative to said upper.

3. The shoe in claim 1 wherein said elastic forefoot slipper sock is totally unattached to said shoe upper to be completely free to stretch and move relative to said upper.

4. The shoe in claim 1 wherein said elastic slipper sock bottom extends to the front of the heel and having its upper part over the instep region.

5. The shoe in claim 4 wherein said elastic slipper sock comprises a stretchable elastic fabric having a foam layer in the instep region to serve also as a shoe tongue.

6. The shoe in claim 1 wherein said bottom of said elastic slipper sock is bonded to said sole assembly to anchor it.

7. The shoe in claim 6 wherein said sole assembly includes a midsole, and said elastic slipper sock bottom is bonded to the top of said midsole and to the bottom of said insole.

8. The aerobic exercise shoe in claim 1 wherein said insole comprises a lower insole member adhered to said elastic slipper sock bottom, on top thereof, and an upper insole member placed on said lower insole member.

9. The aerobic exercise shoe in claim 1 wherein said elastic slipper sock has a rearwardly and upwardly oriented, foot-receiving opening defined by a peripheral edge of said slipper sock which tapers upwardly-forwardly from the heel region at said bottom to the instep region.

10. The shoe in claim 1 including a toe bumper which extends around the toe and rearwardly above both sides of said shoe along said sole assembly, past the widest metatarsal-phalangeal joint line portion of the shoe to the narrower instep region, said toe bumper having vertically narrower portions astraddle said widest portion.

11. The shoe in claim 10 wherein said upper has a vamp which is bifurcated into two portions by a U-shaped gap extending along both sides of the shoe and across the upper, a porous mesh connector extending across said gap and interconnecting said two vamp portions.

12. The shoe in claim 11 wherein said sole assembly includes an outer sole and a midsole, said outer sole having a transverse molded polymeric section underlying the metatarsal-phalangeal joint line.

13. An aerobic exercise shoe comprising:

a sole assembly;

an upper secured to said sole assembly, defining a foot-receiving cavity and having closure means for retention of the shoe on a foot;

a forefoot-enveloping and gripping, elastic slipper sock in said cavity encompassing the forepart of said cavity, said elastic slipper sock having a bottom anchored to said sole assembly at the heel and the remainder of said elastic sipper sock being unattached to said upper to be free to contract onto and move with a foot in said cavity, to stretch and move relative to said upper;

said elastic slipper sock having a rearwardly and upwardly oriented, foot-receiving opening defined by a peripheral edge of said slipper sock which tapers upwardly-forwardly from the heel region at said bottom to the instep region; and an insole having a forward portion in said slipper sock on the inner upper surface of said slipper sock bottom.

14. An athletic shoe comprising:

a sole assembly including an outer sole, a midsole and an inner sole;

an upper secured to said sole assembly, defining a foot-receiving cavity and having closure means for retention of the shoe on a foot;

a toe bumper along said midsole and the lower part of said upper around the toe and rearwardly along both sides of said shoe past the widest metatarsal-phalangeal joint line portion of the shoe to the narrower instep region, said toe bumper having vertically narrower portions astraddle said widest portion to add independence to the toe portion of said sole assembly.

15. The shoe in claim 14 wherein said outer sole has a transverse resilient gum rubber section underlying said joint line portion, between said narrower toe bumper portions, the bottom thereof being substantially at the same level as the bottom of said outer sole.

16. The shoe in claim 15 wherein said upper has a vamp bifurcated by a U-shaped gap extending across the upper, and extending downwardly-rearwardly along both sides of the shoe, a porous mesh connector extending across aid gap and interconnecting said two vamp portions.

17. The shoe in claim 14 including a toe bumper along said midsole and the lower part of said upper around the toe and rearwardly along both sides of said shoe past the widest metatarsal-phalangeal joint line portion of the shoe to the narrower instep region, said toe bumper having vertically narrower portions astraddle said widest portion to add independence to the toe portion of said sole assembly.

18. An athletic shoe comprising:

a sole assembly including an outer sole, a midsole and an inner sole;

an upper secured to said sole assembly, defining a foot-receiving cavity and having closure means for retention of the shoe on a foot;

said upper has a vamp bifurcated by a U-shaped gap extending across the upper, and extending downwardly-rearwardly along both sides of the shoe, and a porous mesh connector extending across said gap and interconnecting said two vamp portions.

19. The shoe in claim 18 having a metatarsal-phalangeal joint line portion and wherein said outer sole has a transverse resilient gum rubber section underlying said joint line portion, the bottom thereof being substantially at the same level as the bottom of said outer sole.

20. An athletic shoe comprising:

a sole assembly including an outer sole, a midsole and an inner sole, and having a metatarsal-phalangeal joint line portion;

an upper secured to said sole assembly, defining a foot-receiving cavity and having closure means for retention of the shoe on a foot;

said outer sole having a transverse resilient gum rubber section underlying said joint line portion, the bottom thereof being substantially at the same level as the bottom of said outer sole.

21. The shoe in claim 20 including:

a toe bumper along said midsole and the lower part of said upper around the toe and rearwardly along both sides of said shoe past the widest metatarsal-phalangeal joint line portion of the shoe to the narrower instep region, said toe bumper having vertically narrower portions astraddle said widest portion to add independence to the toe portion of said sole assembly.

22. The shoe in claim 20 including:

said upper having a vamp bifurcated by a U-shaped gap extending across the upper, and extending downwardly-rearwardly along both sides of the shoe, a porous mesh connector extending across said gap and interconnecting said two vamp portions.

* * * * *